US006572067B1

(12) United States Patent
Kamenstein et al.

(10) Patent No.: US 6,572,067 B1
(45) Date of Patent: Jun. 3, 2003

(54) ADJUSTABLE PICTURE HANGING HOOK

(75) Inventors: Peter Kamenstein, 665 Titicus Rd., North Salem, NY (US) 10560; Joseph P. Opramolla, Rindge, NH (US); Robert Howitt, Leominster, MA (US)

(73) Assignee: Peter Kamenstein, North Salem, NY (US)

( * ) Notice: Subject to any disclaimer, the term of this patent is extended or adjusted under 35 U.S.C. 154(b) by 0 days.

(21) Appl. No.: 10/072,195

(22) Filed: Feb. 7, 2002

Related U.S. Application Data

(63) Continuation-in-part of application No. 09/981,142, filed on Oct. 16, 2001.

(51) Int. Cl.[7] ..... A47G 1/16

(52) U.S. Cl. ..... 248/476; 248/477; 248/495; 248/496; 248/498; 248/466; 248/475.1

(58) Field of Search ..... 248/476, 477, 248/495, 496, 498, 466, 475.1, 80, 222.52, 292.12, 339, 307, 304; 242/403

(56) References Cited

U.S. PATENT DOCUMENTS

| | | | | | |
|---|---|---|---|---|---|
| 201,695 | A | * | 3/1878 | Merrill | 248/304 |
| 445,942 | A | * | 2/1891 | Siddal | 248/495 |
| 522,510 | A | * | 7/1894 | Church | 248/299.1 |
| 696,510 | A | * | 4/1902 | Still | 242/396.4 |
| 891,305 | A | * | 6/1908 | Valliere | 211/103 |
| 999,961 | A | | 8/1911 | Colas | |
| 2,263,901 | A | * | 11/1941 | Olney | 248/496 |
| 3,298,655 | A | | 1/1967 | Palm | |
| 3,330,525 | A | | 7/1967 | Weinstein | |
| 3,529,799 | A | | 9/1970 | Schaefer | |
| 3,848,843 | A | | 11/1974 | Levy | |
| 3,865,342 | A | | 2/1975 | Kanzelberger | |
| 4,094,490 | A | * | 6/1978 | Einhorn | 248/304 |
| 4,290,216 | A | | 9/1981 | Gale | |
| 4,611,780 | A | | 9/1986 | Robertson | |
| 5,255,885 | A | * | 10/1993 | Iversen | 248/220.22 |
| 5,462,298 | A | * | 10/1995 | Bodine | 242/399.2 |
| 5,605,313 | A | | 2/1997 | Erickson et al. | |
| 5,695,147 | A | * | 12/1997 | Zimmerman | 242/388.3 |

* cited by examiner

*Primary Examiner*—Korie Chan
*Assistant Examiner*—Ingrid Weinhold
(74) *Attorney, Agent, or Firm*—Cowan, Liebowitz & Latman, P.C.; Mark Montague

(57) ABSTRACT

An assembly for hanging picture frames and other objects to a vertical support includes a base adapted to be mounted to the vertical support, a wheel supported by the base and rotatable on the base, and a hook rotatably coupled to the wheel and adapted to rotate upon rotation of the wheel relative to the base. The hook includes a hooked portion that receives an item to be mounted thereon.

13 Claims, 3 Drawing Sheets

ADJUSTABLE PICTURE HANGING HOOK

RELATED APPLICATION

This application is a continuation-in-part of U.S. application Ser. No. 09/981,142, filed Oct. 16, 2001, which is incorporated herein by reference.

FIELD OF THE INVENTION

The present invention relates to an improved adjustable picture hanging hook and, more particularly, to a picture hanging hook capable of allowing the vertical and/or horizontal position of an item to be hung thereon to be adjusted without having to re-mount the picture hanging hook.

BACKGROUND OF THE INVENTION

A variety of picture hangers have been previously designed and sold for the purpose of hanging picture frames and other items on walls and other vertical surfaces. Standard picture hangers typically are formed pieces of metal mounted to a wall by one or more nails and that include some sort of hook on which a picture frame is supported. Typically, wire extending across the rear side of a picture frame is supported by the picture hanger's hook.

One common problem associated with such standard picture hangers is the difficult task of positioning the picture hanger on the wall at an appropriate location such that the picture to be mounted thereon is located at the exact, desired location. A picture hanger is mounted to a wall usually by a nail. Mounting a picture hanger too high or too low, or too far to the right, or too far to the left, of the desired location, even by a fraction of an inch, in turn leads to the undesirable task of remounting the picture hanger itself, this time at a different location on the wall. Such remounting is wasteful, time consuming and results in the creation of unnecessary holes in the wall. These additional, unnecessary holes are aesthetically undesirable, may result in reduced wall strength, and ultimately need to be repaired. Still further, an already mounted picture frame may later need to be remounted as a result of shifting of walls which often occurs after a newly constructed structure has settled.

In addition to standard picture hangers, a variety of hangers have been designed that attempt to overcome the above-mentioned problem of standard hangers. For example, U.S. Pat. Nos. 3,330,525, 4,611,780, and 5,605,313 disclose just a few examples of hangers designed to provide multiple positions on which a picture frame may be mounted. However, while such prior art designs attempt to simplify mounting, none provide the user with both ease of use and a range of mounting positions to enable for quick and efficient mounting of a picture frame or other item to be hung.

OBJECTS OF THE INVENTION

Therefore, it is an object of the present invention to provide a picture hanging hook (sometimes called picture hanger or, simply, hanger herein) that is easy to use and manufacture and, at the same time, overcomes the above-mentioned problem associated with standard picture books.

It is a further object of the present invention to provide a picture hanging hook that enables for the easy modification of the picture hanging position in the vertical and/or horizontal directions.

It is another object of the present invention to provide a picture hanging hook that, once mounted to the wall, alleviates both the need to re-mount the picture hanging hook and alleviates any need to lengthen or shorten the wire which is attached to the frame.

Various other objects, advantages and features of the present invention will become readily apparent to those of ordinary skill in the art, and the novel features will be particularly pointed out in the appended claims.

SUMMARY OF THE INVENTION

In accordance with the present invention, an assembly for hanging picture frames and other objects to a vertical support includes a base adapted to be mounted to the vertical support, a wheel supported by the base and rotatable relative to the base, and a hook rotatably coupled to the wheel. The hook is adapted to rotate upon rotation of the wheel relative to the base, and the hook includes a hooked portion that can receive the item to be mounted thereon.

As an aspect of the invention, the hooked portion remains properly oriented to receive the item to be mounted thereon independent of the position of the wheel relative to the base.

As another aspect of the invention, the hook is disposed off-center to the front surface of the wheel.

As a further aspect of the invention, the base includes a bottom surface on which is provided a plurality of locking grooves. The wheel is disposed on a front surface of the base and includes a set of teeth disposed around the wheel's perimeter, and one of the teeth disposed on the bottom of the wheel is received by one of the locking grooves in the base.

As yet another aspect, the wheel can be raised so that none of the wheel's teeth are disposed in any of the base's locking grooves, and the wheel is longitudinally movable relative to the base when the wheel is in the raised position and the wheel can not longitudinally move relative to the base when lowered.

As a feature, the base includes an aperture that extends along the base and a stem extends from the center of the rear surface of the wheel. A holding disk is fixed to the stem, the stem extends through the aperture in the base and the holding disk is disposed behind the base. The holding disk has a diameter greater than a largest height of the aperture in the base so that the holding disk prevents the wheel from being fully separated from the base.

As another feature, the locking grooves include alternating teeth and recesses disposed along the entire bottom surface of the base, and the recesses receive the teeth disposed around the wheel.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE INVENTION

Figure 1:
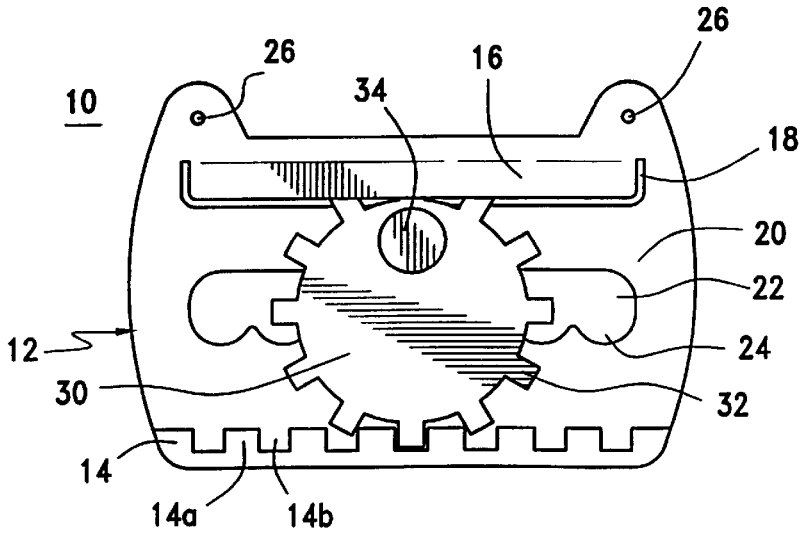
FIG. 1 is a schematic illustration of a front view of the adjustable picture hanging hook of the present invention, shown with the hook's wheel in a first position.
Figure 2:
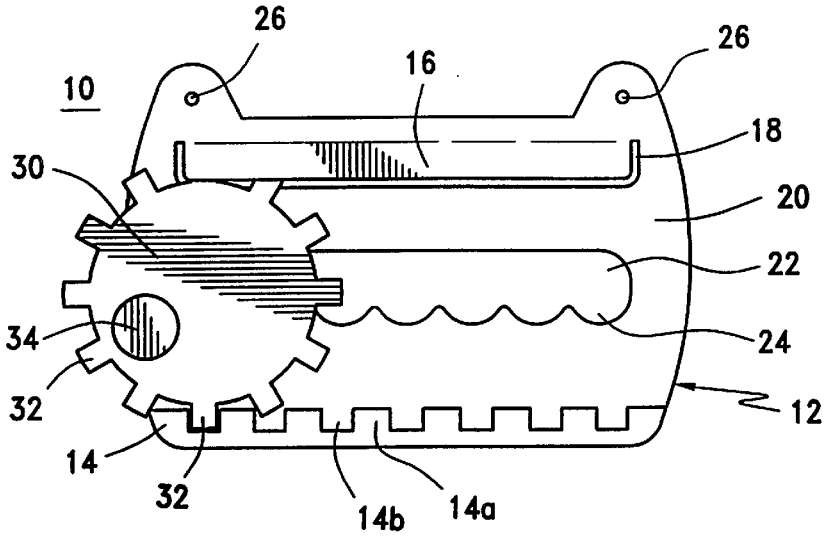
FIG. 2 is another schematic illustration of the front view of the adjustable picture hanging hook of the present invention, shown with the wheel in a second position.

Referring to the drawings, FIGS. 1 and 2 thereof are front view illustrations of the adjustable picture hanging hook of the present invention. As shown, the adjustable picture hanging hook 10 (or simply, hanger 10) includes two main components: a support base 12 and a movable wheel 30. Support base 12 (or simply, base 12) and wheel 30 are movable relative to each other, as described further below. Base 12 includes a number of structural features including a set of rectangular teeth-shaped locking grooves 14 disposed on the bottom of base 12. Locking grooves 14 includes alternating teeth 14*a* and recesses 14*b* and, as will be discussed, operate to prevent the rotation of wheel 30 once locked in place. Base 12 further includes a rim 16 extending along the base's top portion and which is disposed apart from the base's central portion 20 to provide a longitudinal gap 18 that extends along the base's top and in which a portion of wheel 30 is disposed, as will be further described. As is appreciated, rim 16 assists in retaining wheel 30 to base 12, and provides additional strength to the device so that it can suitably support heavy items to be mounted. However, since holding disk 36 also retains wheel 30 to base 12 (to be discussed below), rim 16 can be removed.

Base 12 further includes a central aperture 22 disposed in its central portion 20. Central aperture 22 extends along base 12's width and includes, extending along its bottom, a number of rounded cavities 24. As will be discussed, central aperture 22 and its cavities 24 serve to maintain the established horizontal position of wheel 30.

Base 12 includes two holes 26 that are used for the purpose of mounting hanger 10 of the present invention to a wall, other surface or generally vertical support. In a preferred embodiment, holes 26 are angled slightly downward (from the hanger's front to back) so that two nails are hammered through the holes at an angle (e.g., 45 degree angle) relative to the mounting surface (e.g., wall).

Figure 3:
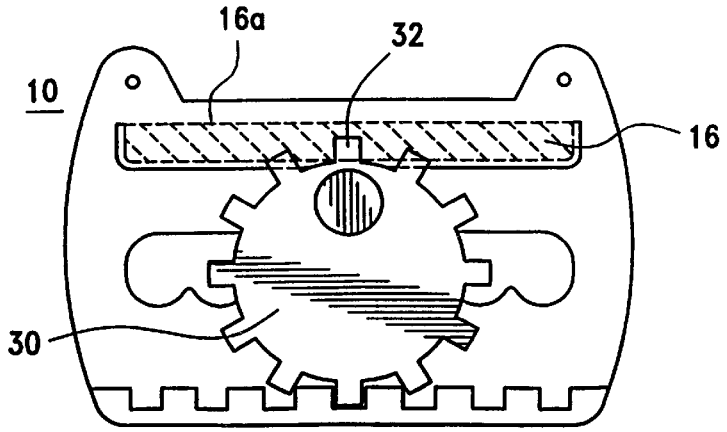
FIG. 3 is a further schematic illustration, partially in phantom, of the adjustable picture hanging hook of the present invention.

Referring now to wheel 30, the wheel is circular in shape and includes a set of teeth 32 extending outward along the wheel's perimeter. Teeth 32 are sized and spaced sufficiently apart so that each tooth can be disposed within an opposing recess 14*b* of the locking grooves 14 of base 12, such as shown in FIGS. 1 and 2. Wheel 30, along with its teeth 32, is of sufficient size (i.e., diameter) so that when a tooth 32 is disposed within an opposing recess 14*b*, wheel 30 has at least another tooth 32 that is disposed within the longitudinal gap 18 that extends below the base's rim 16. This also is illustrated in FIG. 3, where rim 16 is shown partially in phantom. Moreover, there is sufficient distance between the tooth 32 that is disposed within gap 18 and the hidden end surface 16*a* of rim 16 (FIG. 3) so as to allow wheel 30 to be raised upwards (towards surface 16*a*) thus freeing the other tooth 32 from the opposing recess 14*b* of the locking grooves 14. Then, in such raised position, wheel 30 is freely rotatable. As will be further described below, these features enable for the varying of a picture frame's mounting position after the hanger of the present invention is mounted to a wall.

Figure 4:
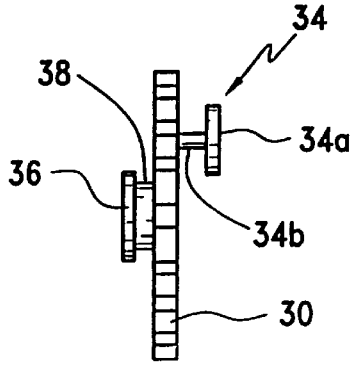
FIG. 4 is a side view illustration of the movable wheel of the adjustable picture hanging hook of the present invention.

Referring again to FIGS. 1 and 2, and also to FIG. 4, a knob 34 is fixed to and extends from wheel 30 and operates as the "hook" on which a picture frame is mounted. As shown in FIG. 4, which is a side view of wheel 30 and the attached elements, knob 30 is comprised of a relatively flat, round button-like portion 34*a* coupled to or integral with a narrow stem 34*b* that is fixed to wheel 30 (component dimensions not drawn to scale in FIG. 4). In the preferred embodiment, both button 34*a* and stem 34*b* of the knob are round in shape and are concentric with one another, so that knob 34 sufficiently is able to retain the wire of a picture frame regardless of the angular position of wheel 30 (further discussed below).

In both FIGS. 1 and 2, it is seen that knob 34 is fixed to wheel 30 at a position offset from the wheel's center. Preferably, knob 34 is fixed on wheel 30 at a position that maximizes the knob's vertical movement, which is achieved by fixing the knob on the wheel at a position that is able to come in close proximity to rim 16 (when wheel 30 is rotated), such as shown in FIG. 1. Then, knob 34 can be positioned adjacent to the locking grooves 14, adjacent to rim 16 (FIG. 1), or at any vertical position in between (e.g., FIG. 2).

Figure 5:
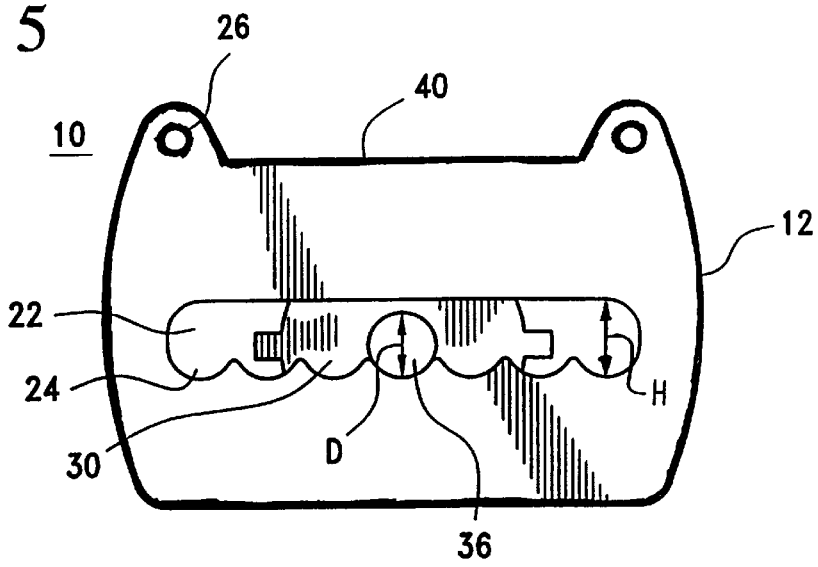
FIG. 5 is a rear view of the adjustable picture hanging hook of the present invention.

To prevent wheel 30 from being fully separated from base 12, a holding disk 36 is fixed via a locking stem 38 (disk 36 and locking stem 38 may comprise a single element or separate elements) to the rear of wheel 30, as shown in FIG. 4, and during assembly of the picture hanger of the present invention, the holding disk is disposed behind the base with locking stem 38 extending through central aperture 22. FIG. 5 is a rear view of the picture hanger and shows disk 36 disposed behind base 12 with wheel 30 disposed in front of the base (locking stem 38 not shown in FIG. 5). Disk 36 preferably has a diameter D greater than the largest height H of central aperture 22 so that disk 36 is unable to pass through central aperture 22 regardless of the wheel's position relative to the base. However, while it is preferred for disk 36 to be sufficiently large so as to keep wheel 30 and base 12 always together, it is not critical to actually keep these components together when the hanger of the present invention is not in use.

Figure 6:
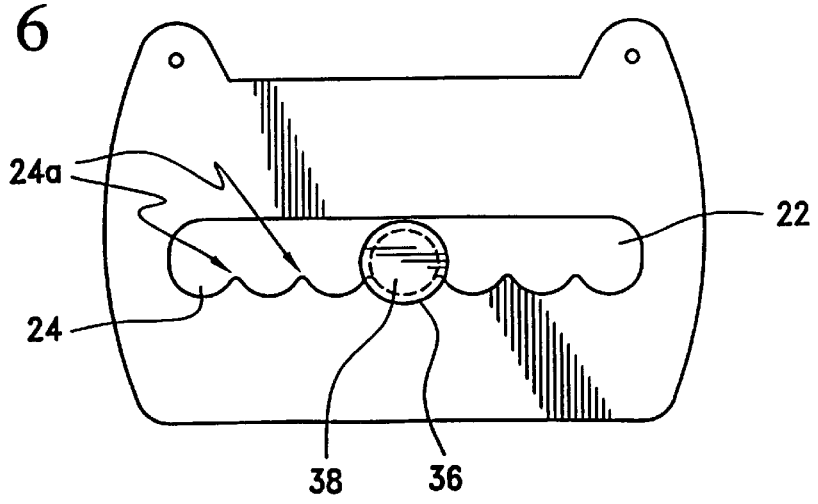
FIG. 6 is another rear view of the adjustable picture hanging hook of the present invention.

Stem 38, in addition to coupling disk 36 to wheel 30, serves as a locking mechanism by being retained within one of the rounded cavities 24 of the central aperture 22, as shown in FIG. 6 (in FIG. 6, stem 38 shown in phantom, wheel 30 and ridge 40 not shown). Both disk 36 and locking stem 38 are round and concentric to one another, and are concentric to wheel 30 (see FIG. 4). Locking stem 38 has a diameter of sufficient size so that it is supported by one of the rounded cavities 24 when wheel 30 is fully lowered, that is, when one of the wheel's teeth 32 is disposed within an opposing recess 14*b* of the locking grooves 14 of base 12. Moreover, the distance between the centers of adjacent cavities 24 is the same as the distance between the centers of adjacent recesses 14*b* (or teeth 14*a*) of locking grooves 14 so that locking stem 38 is accommodated by a respective cavity 24 for each possible horizontal position of wheel 30. Then, in the lowered position, the peaks 24*a* (shown in FIG. 6) of cavity 24 in which locking stem 38 is disposed prevent wheel 30 from moving horizontally. Conversely, when wheel 30 is raised, locking stem 38 is disposed above peaks 24*a* of cavities 24 so that wheel 30 is able to be moved horizontally (longitudinally). In this raised position, wheel 30 and all of its teeth 32 are disposed above locking grooves 14 (FIGS. 1 and 2) so that wheel 30 also is freely rotatable, as previously discussed.

Referring again to FIG. 5, the rear side of hanger 10 of the present invention includes a ridge 40 that extends along the perimeter of base 12. Ridge 40 is of sufficient thickness (depth) so that the base's center 20 is disposed slightly away from a wall to which hanger 10 is mounted thus enabling the movement of wheel 30, more particularly, disk 36. Ridge 40 needs to be only slightly thicker than disk 36 to ensure a small gap between disk 36 and the wall to which the hanger of the present invention is mounted. That is, without providing a suitably thick ridge 40, disk 36 is in immediate contact with a wall when hanger 10 is mounted, which in turn would make it difficult to move or turn wheel 30. Moreover, ridge 40 also extends to the vicinity of holes 26 so that nails can be properly driven and secured to a wall.

To utilize the adjustable picture hanging hook of the present invention, hanger 10 is mounted to a wall in a manner similar to that of prior art devices, namely, hanger 10 is appropriately positioned on a surface onto which it is to be mounted (hereinafter, wall) and suitably sized nails are driven through holes 26 and into the wall thus securing hanger 10 to the wall. Next, the item to be hung (hereinafter, picture frame) is mounted on hanger 10 by, for example, hanging the mounting wire disposed on the rear of the picture frame onto knob 34. Once mounted, the user determines whether the horizontal and vertical positions of the mounted picture frame are acceptable. If either the vertical or horizontal position is not acceptable or correct, then the picture frame mounting position needs to be adjusted. At this point, in most prior art devices, either the hanger itself will need to be remounted on the wall or the wire attached to the picture will need to be lengthened or shortened.

The present invention, however, allows the picture frame mounting position to be adjusted without remounting the hanger and without changing the length of the wire attached to the picture frame. To adjust the picture frame mounting position, wheel 30 is moved in the manner previously discussed. In particular, if the horizontal position of the picture frame mounting position needs to adjusted, then wheel 30 is manually raised and is moved to the left or right accordingly, without any rotation of the wheel, and then lowered. FIGS. 1 and 2 show the hanger of the present invention with seven (7) recesses 14*b* (in locking grooves 14) thus allowing for the placement of the picture frame mounting position in seven horizontal positions. Of course, seven recesses is merely exemplary, and the hanger of the present invention may include any reasonable number of recesses (i.e., horizontal positions). Moreover, additional recesses may be provided without increasing the relative size of the entire hanger itself, simply by reducing the size of each recess 14*b* and tooth 14*a*, as well as by reducing the size of each wheel tooth 32 and increasing the number of such teeth 32 on the wheel (as well as the size and number of rounded cavities 24 within central aperture 22 and the diameter of locking stem 38).

If the vertical position of the picture frame mounting position needs to be adjusted, then wheel 30 is manually raised and is rotated so that knob 34 is moved upwards or downwards accordingly, and then lowered. Of course, if only the vertical position needs to be adjusted (i.e., the horizontal picture frame mounting position is acceptable), then wheel 30 may need to be moved slightly to the left or right to maintain knob 34's horizontal position as wheel 30 is rotated. Similarly, if both the vertical and horizontal positions of the picture frame mounting position need to be adjusted, then wheel 30 (after being raised) may be both rotated and moved left or right as needed. Wheel 30 then is lowered and locked in place by both sets of locking devices (i.e., locking grooves 14 and rounded cavities 24). Adjustment of the picture frame mounting position now has been achieved without remounting the hanger itself.

Referring back to FIG. 2, it is seen that it is possible to establish picture frame mounting positions at locations that extend beyond the hanger's support base 12. Advantageously, the horizontal range of picture frame mounting positions extends past the left and right ends of hanger 10 of the present invention, and the vertical range of picture frame mounting positions extends between the bottom of base 12 to the base's rim 16. Given such extended horizontal and vertical ranges, the hanger of the present invention allows a user to merely approximate the desired mounting position by mounting the hanger to a wall at such approximated position, and then to select the exact, desired picture frame mounting position by moving wheel 30 in the manner described herein. Moreover, after wheel 30 is locked in place (by lowering it fully), wheel 30 is prevented from moving in any direction and is prevented from rotating, even with the weight of the mounted picture frame on knob 34, by means of the locking devices previously discussed. Still further, and as previously mentioned, additional mounting positions may be established by increasing the number of teeth 14*a*, recesses 14*b*, wheel teeth 32, and rounded cavities 24, and accordingly reducing their size as well as the diameter of locking stem 38.

Figure 8:
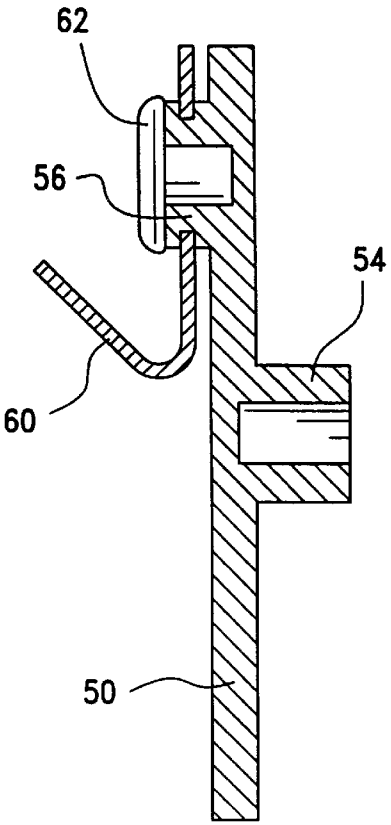
FIG. 8 is a side view of the wheel and hook shown in FIG. 7.
Figure 7:
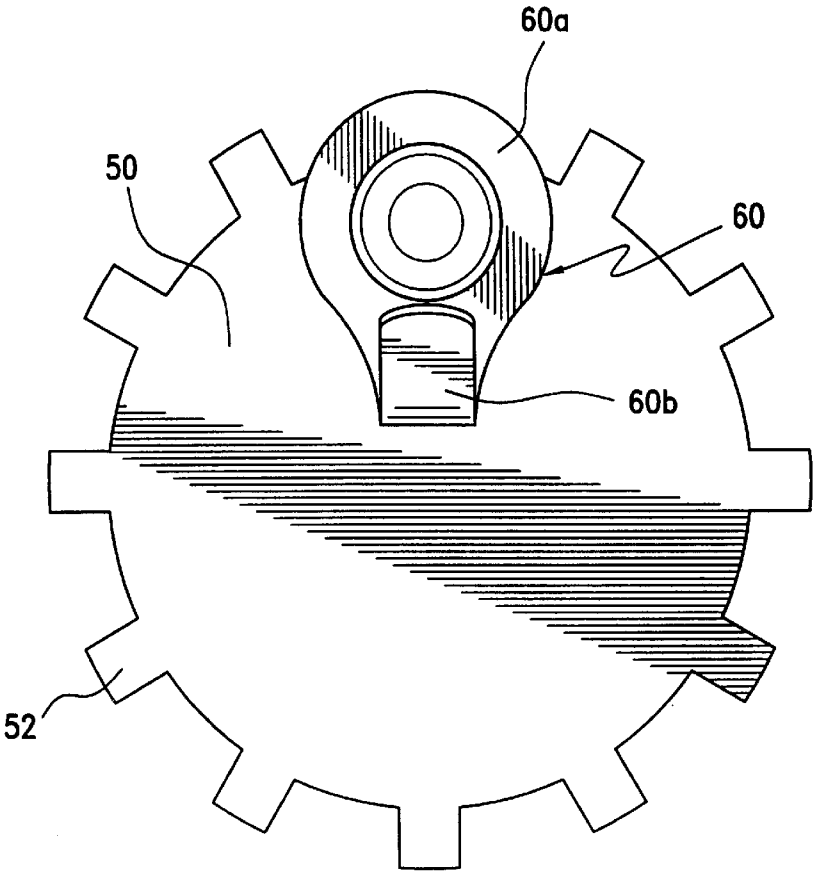
FIG. 7 is a front view of the wheel with an attached hook in accordance with another embodiment of the present invention.

FIGS. 7 and 8 of the drawings schematically illustrate a modified design of the wheel and attached hook in accordance with another embodiment of the present invention. Wheel 50 is quite similar to wheel 30 of the design previously discussed. As shown in FIG. 7, wheel 50 is circular in shape and includes a set of teeth 52 that extend outward along the wheel's perimeter. As shown in FIG. 8, wheel 50 includes a rear stem 54 that extends from its rear center and a disk is attached to the end of stem 54 (disk not shown in FIG. 8) similar to disk 36 shown in FIGS. 4 and 6. As is appreciated, wheel 50 and each of its components operate in a manner identical to wheel 30 previously discussed.

Wheel 50 further includes a front stem 56 extending off-center from the wheel's front surface. Front stem 56 is similar to stem 34*b* of the previously discussed design shown in FIG. 4, except the embodiment shown in FIGS. 7 and 8 includes a hook portion 60 that is rotatably coupled to stem 56, and hook portion 60 (or simply hook 60) operates as the "hook" on which a picture frame is mounted. Hook 60 includes a circular section 60*a* that includes a circular aperture through which stem 56 extends, and a hooked section 60*b* that serves to retain the wire that extends across the rear side of a picture frame (or other suitable item extending from the rear of a picture frame such as a loop or other shape to be held). So that hook 60 may freely rotate about stem 56, the circular aperture of hook 60 has a diameter that is slightly larger than the diameter of stem 56. Wheel 50 further includes a trap piece or button 62 attached to the end of stem 56 and serves to retain hook 60.

In operation, the position of hook 60 relative to the wall to which the hanger of the present invention is mounted is changed in any manner previously discussed. That is, wheel 50 may be moved horizontally relative to base 12 and/or may be rotated. Upon rotation of wheel 50, hook 60 also rotates to allow the hook section 60*b* to always remain at a proper orientation to retain the picture frame wire. For example, after the hanger of the present invention is mounted to a wall in the manner previously discussed, and after test-mounting of a picture thereon, by retention of the picture's wire by hook 60, the position of the mount may be modified by removal of the picture, re-positioning of the location of hook 60 (by horizontal movement and/or rotation of wheel 50), and then re-mounting the picture. Since hook 60 rotates, due to gravity (i.e., the weight of hooked portion 60*b*), when wheel 50 is rotated, the hanger of the present invention always is ready to receive the wire of a picture frame.

The design shown in FIGS. 7 and 8 provide various advantageous features, in addition to those previously mentioned, that include retention of relatively thick pictures wires and added strength, both due to the use of hook 60. Moreover, hook 60 appears quite similar to ordinary picture frame hooks so that users readily know on what component of the hanger of the present invention (i.e., hooked portion 60*b*) to place the picture frame's wire.

While the present invention has been particularly shown and described in conjunction with a preferred embodiment thereof, it will be readily appreciated by those of ordinary skill in the art that various changes may be made without departing from the spirit and scope of the invention. For example, the various shapes of teeth 32, recesses 14*b*, rounded cavities 24, as well as other components of the hanger, may be different from that shown. For example, teeth 32 and recesses 14*b* may be pointed.

As another example, holes 26 may be provided in different positions than that shown, such as within the base's central portion 20, with the nails being recessed within ridge 40 so that they do not interfere with the movement of wheel 30. Also, the hanger of the present invention may be constructed from any suitable material, such as plastic or metal (or other material), with such suitable material being chosen by one of ordinary skill depending on the particular application necessary (e.g., weight of the item to be hung).

As a further example, the embodiment shown in FIGS. 7 and 8 shows a specific design on which hook 60 is rotatably attached to wheel 50. However, other known connection techniques also may be used.

Therefore, it is intended that the appended claims be interpreted as including the embodiments described herein, the alternatives mentioned above, and all equivalents thereto.

What is claimed is:

1. An assembly for hanging picture frames and other objects to a vertical support, comprising:

a base adapted to be mounted to the vertical support;

a wheel supported by the base, the wheel adapted to be rotatable relative to the base; and a hook rotatably coupled to the wheel and adapted to rotate upon rotation of the wheel relative to the base, the hook including a hooked portion adapted to receive an item to be mounted thereon.

2. The assembly of claim 1, wherein the hooked portion is adapted to remain oriented to receive the item to be mounted thereon independent of a position of the wheel relative to the base.

3. An assembly for hanging picture frames and other objects to a vertical support, comprising:

a base adapted to be mounted to the vertical support;

a wheel supported by the base, the wheel adapted to be rotatable relative to the base; and a hook rotatably coupled to the wheel and adapted to rotate upon rotation of the wheel relative to the base, the hook including a hooked portion adapted to receive an item to be mounted thereon;

the hook being disposed off-center to a front surface of the wheel.

4. An assembly for hanging picture frames and other objects to a vertical support, comprising:

a base adapted to be mounted to the vertical support;

a wheel supported by the base, the wheel adapted to be rotatable relative to the base; and a hook rotatably coupled to the wheel and adapted to rotate upon rotation of the wheel relative to the base, the hook including a hooked portion adapted to receive an item to be mounted thereon;

the base including a bottom surface on which is provided a plurality of locking grooves; the wheel being disposed on a front surface of the base and including a set of teeth disposed around the wheel's perimeter, and one of the teeth disposed on a bottom of the wheel being received by one of the plurality of locking grooves in the base.

5. The assembly of claim 4, wherein the wheel is adapted to be moved to a raised position so that none of the teeth disposed around the wheel are disposed in any of the plurality of locking grooves in the base, and the wheel is longitudinally movable relative to the base when the wheel is in the raised position and the wheel is not longitudinally movable relative to the base when not in the raised position.

6. The assembly of claim 5, wherein the wheel is adapted to be selectively rotated relative to the base when the wheel is in the raised position.

7. The assembly of claim 4, wherein the base includes an aperture extending along a length of the base;

the assembly further comprising a stem fixed to and extending from a center of a rear surface of the wheel, and a holding disk fixed to the stem; the stem extending through the aperture in the base and the holding disk being disposed behind the base; the holding disk having a diameter greater than a largest height of the aperture in the base so that the holding disk prevents the wheel from being fully separated from the base.

8. The assembly of claim 4, wherein the base includes an aperture extending along a length of the base, the aperture having a plurality of cavities extending along its bottom;

the assembly further comprising a stem fixed to and extending from a center of a rear surface of the wheel, and a holding disk fixed to the stem; the stem extending through the aperture in the base and the holding disk being disposed behind the base, the stem being sized to be received within a respective one of the cavities of the aperture when one of the teeth disposed on the bottom of the wheel is received by one of the plurality of locking grooves of the base.

9. The assembly of claim 8, wherein the stem and cavities are sized to enable the stem to be raised above the cavities when the wheel is lifted relative to the base to a raised position.

10. The assembly of claim 9, wherein the teeth disposed around the wheel are sized to be disposed above the plurality of locking grooves when the wheel is in the raised position.

11. The assembly of claim 8, further comprising a ridge extending from a rear surface of the base and adapted to provide a gap between the base and the vertical support when the base is mounted to the vertical support; the holding disk being disposed in the gap and being movable relative to the base without interference by the vertical support.

12. The assembly of claim 4, wherein the base includes a rim extending along the base's top surface, the rim extending away from the base and defining a longitudinal gap; and at least one of the teeth around the wheel being disposed within the gap.

13. The assembly of claim 4, wherein said plurality of locking grooves includes alternating teeth and recesses disposed along the entire bottom surface of the base, the recesses being adapted to receive one of the teeth disposed around the wheel.

* * * * *